US009586663B2

(12) United States Patent
Kinpara et al.

(10) Patent No.: US 9,586,663 B2
(45) Date of Patent: Mar. 7, 2017

(54) INTAKE APPARATUS OF ENGINE FOR OUTBOARD MOTOR

(71) Applicant: SUZUKI MOTOR CORPORATION, Hamamatsu-shi, Shizuoka (JP)

(72) Inventors: Masatoshi Kinpara, Hamamatsu (JP); Akinori Yamazaki, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 203 days.

(21) Appl. No.: 14/498,550

(22) Filed: Sep. 26, 2014

(65) Prior Publication Data

US 2015/0093948 A1 Apr. 2, 2015

(30) Foreign Application Priority Data

Sep. 27, 2013 (JP) ..... 2013-201993
Sep. 27, 2013 (JP) ..... 2013-201994

(51) Int. Cl.
*B63H 20/00* (2006.01)

(52) U.S. Cl.
CPC ..... *B63H 20/001* (2013.01)

(58) Field of Classification Search
CPC ..... B63H 20/32; F02B 61/045
See application file for complete search history.

(56) References Cited

U.S. PATENT DOCUMENTS

| | | | | |
|---|---|---|---|---|
| 5,596,962 | A | 1/1997 | Tsunoda et al. | 123/184.39 |
| 6,302,749 | B1 * | 10/2001 | Tawa | F01P 1/06 440/76 |
| 2005/0079775 | A1 | 4/2005 | Katayama | 440/77 |

FOREIGN PATENT DOCUMENTS

| | | | |
|---|---|---|---|
| JP | 56-94847 | | 12/1979 |
| JP | 55-154358 | | 11/1980 |
| JP | 57-109262 | | 7/1982 |
| JP | 8-93581 | A | 4/1996 |
| JP | 2004-299485 | A | 10/2004 |
| JP | 2007-8416 | A | 1/2007 |
| JP | 2007-107481 | A | 4/2007 |

(Continued)

OTHER PUBLICATIONS

Japanese Office Action dated Nov. 8, 2016, issued by the Japanese Patent Office in corresponding application JP 2013-201993.

(Continued)

*Primary Examiner* — Edwin Swinehart
(74) *Attorney, Agent, or Firm* — Stein IP, LLC

(57) ABSTRACT

There is provided an intake apparatus of an engine for an outboard motor. An intake manifold, a throttle body and an intake silencer box are arranged at one of right and left sides of an engine block which is configured such that an axial direction of a cylinder coincides with a front and rear direction of the outboard motor. An intake duct communicating with an intake introduction port provided at an upper part of an engine cover is coupled to an upstream end of the intake silencer box. A first water separation part is arranged between the intake introduction port and the intake duct. A second water separation part is provided below a duct part of the intake duct. The second water separation part is formed by providing a drain hole at a bottom part of a resonator chamber part communicating with the duct part to reduce an intake noise.

6 Claims, 9 Drawing Sheets

(56) References Cited

FOREIGN PATENT DOCUMENTS

| | | | |
|---|---|---|---|
| JP | 2008-88881 | A | 4/2008 |
| JP | 2012-041870 | A | 3/2012 |
| JP | 2013-96342 | A | 5/2013 |

OTHER PUBLICATIONS

Japanese Office Action dated Nov. 8, 2016, issued by the Japanese Patent Office in corresponding application JP 2013-201994.

* cited by examiner

INTAKE APPARATUS OF ENGINE FOR OUTBOARD MOTOR

The disclosure of Japanese Patent Application No. 2013-201993 and Japanese Patent Application No. 2013-201994 filed on Sep. 27, 2013, including specifications, drawings and claims is incorporated herein by reference in its entirety.

TECHNICAL FIELD

The present invention relates to an intake apparatus of an engine for an outboard motor, and more particularly, to an intake apparatus of an engine for an outboard motor configured to supply an air for combustion into a combustion chamber in the engine for the outboard motor.

BACKGROUND

As an intake apparatus configured to introduce an air for combustion into an engine for an outboard motor, there is an intake apparatus configured to introduce an exterior air through an engine cover (for example, refer to Patent Documents 1 and 2). In the intake apparatus, the exterior air introduced in the engine cover is delivered to an engine room. Then, the air flows in a space in the vicinity of an engine accommodated in the engine room and is then delivered to a combustion chamber. The exterior air introduced into the engine cover is warmed up during the flowing in the vicinity of the engine. For this reason, an engine output is lowered and a fuel consumption is deteriorated.

Therefore, as one of configurations for improving the fuel consumption of the outboard motor, there is proposed an intake apparatus which directly supplies the exterior air introduced from an exterior air introduction port of the engine cover to a throttle body without allowing the exterior air to flow in the space in the vicinity of the engine (for example, refer to Patent Document 3). According to this intake apparatus, since the exterior air is supplied to the throttle body without warming up the exterior air, it is possible to improve the engine output and the fuel consumption.

On the other hand, according to the above intake apparatus, a noise associated with the intake (an intake noise) is likely to occur and water such as ocean water is likely to enter into the engine. For this reason, it is important to suppress the intake noise and the entry of the water into the engine. According to the intake apparatus disclosed in Patent Document 3, an interference-type silencer is arranged on a flow path from the intake introduction port of the engine cover to the throttle body, thereby reducing the intake noise.

Patent Document 1: Japanese Patent Application Publication No. 2007-008416A

Patent Document 2: Japanese Patent Application Publication No. 2008-088881A

Patent Document 3: Japanese Patent Application Publication No. 2013-096342A

According to the intake apparatus disclosed in Patent Document 3, the exterior air introduced into the engine cover flows in an upper side area of the engine. The exterior air is supplied to the throttle body arranged at an upper side of the engine. For this reason, it is necessary to secure a predetermined space at the upper side of the engine in the engine cover. As a result, a size (particularly, a size in a vertical direction) of the intake apparatus is enlarged.

In addition, in the intake apparatus, the temperature of the introduced exterior air highly influences an intake packing efficiency of the engine. That is, it is known that an increase in the temperature of the introduced exterior air lowers the engine output and deteriorates the fuel consumption. For this reason, it is highly important to supply the introduced exterior air to the throttle body without increasing the temperature of the introduced exterior air, from a standpoint of improvements on the engine output and the fuel consumption.

SUMMARY

It is an object of the present invention to provide an intake apparatus of an engine for an outboard motor capable of suppressing an intake noise and effectively preventing entry of water into the engine without enlarging an apparatus main body.

It is another object of the present invention to provide an intake apparatus of an engine for an outboard motor capable of improving an intake packing efficiency of an engine by an exterior air without enlarging an apparatus main body.

According to an aspect of the embodiments of the present invention, there is provided an intake apparatus of an engine for an outboard motor in which an intake manifold, a throttle body and an intake silencer box which are coupled to an upstream end side of the intake manifold are arranged at one of right and left sides of an engine block which is configured such that an axial direction of a cylinder coincides with a front and rear direction of the outboard motor, wherein an intake duct configured to communicate with an intake introduction port provided at an upper part of an engine cover is coupled to an upstream end of the intake silencer box, and wherein a first water separation part is arranged between the intake introduction port and the intake duct, a second water separation part is provided below a duct part of the intake duct, and the second water separation part is formed by providing a drain hole at a bottom part of a resonator chamber part configured to communicate with the duct part to reduce an intake noise.

According to the above configuration, the intake manifold, the throttle body and the intake silencer box are intensively arranged at one of the right and left sides of the engine block, and the intake introduction port provided at the upper part of the engine cover and the intake silencer box are coupled by the intake duct. For this reason, it is possible to circulate an exterior air by using a space at the one of the right and left sides of the engine block and supply the exterior air to the throttle body. Thereby, it is possible to prevent a size of an apparatus main body (particularly, a size in a vertical direction) from being enlarged. Also, since the intake silencer box is provided and the resonator chamber part is provided in communication with the duct part of the intake duct, it is possible to reduce the intake noise on a flow path to the throttle body. Furthermore, since the first water separation part is provided between the intake introduction part and the intake duct and the second water separation part is provided in a part of the resonator chamber part, it is possible to separate water contained in the exterior air on the flow path to the throttle body. As a result, it is possible to suppress the intake noise and to effectively prevent the entry of the water into the engine without enlarging the apparatus main body.

In the above intake apparatus, it is preferable that a flowing direction of an intake air flowing in the intake duct and a flowing direction of the intake air flowing in the throttle body and the intake manifold are reversed in the front and rear direction of the outboard motor in the intake silencer box which couples the intake duct and the throttle body, and a bottom part of the intake silencer box is provided with a drain hole to form a third water separation part. In this case, since the third water separation part is provided in a part of the intake silencer box configured to reverse the flowing direction of the intake air in the intake duct and the flowing direction of the intake air in the throttle body and the intake manifold, it is possible to further separate the water contained in the exterior air. Thereby, it is possible to more effectively prevent the entry of the water into the engine.

In the above intake apparatus, it is preferable that the intake introduction port is provided at a rear side of the outboard motor, and an intake passage is formed such that the intake air flowing in the intake duct flows from the rear side of the outboard motor towards a front side thereof. In this case, the intake duct is formed such that the intake passage is provided from the rear side of the outboard motor towards the front side thereof. For this reason, it is possible to secure a length of the intake duct in a front and rear direction of the outboard motor. The resonator chamber part is provided in communication with the duct part configuring the intake passage of the intake duct. Thereby, as compared to a configuration where the length of the intake passage of the intake duct cannot be secured, it is possible to secure a degree of design freedom as regards a volume of the resonator chamber part. As a result, it is possible to selectively reduce the intake noise having a desired frequency.

According to another aspect of the embodiments of the present invention, there is provided an intake apparatus of an engine for an outboard motor in which an intake manifold, a throttle body and an intake silencer box which are coupled to an upstream end side of the intake manifold are arranged at one of right and left sides of an engine block which is configured such that an axial direction of a cylinder coincides with a front and rear direction of the outboard motor, wherein an intake duct configured to communicate with an intake introduction port provided at an upper part of an engine cover is coupled to an upstream end of the intake silencer box, and wherein the intake duct and the intake manifold are arranged parallel to each other and side by side in a vertical direction.

According to the above configuration, the intake manifold, the throttle body and the intake silencer box are intensively arranged at one of the right and left sides of the engine block, and the intake introduction port provided at the upper part of the engine cover and the intake silencer box are coupled by the intake duct. For this reason, it is possible to circulate an exterior air by using a space at one of the right and left sides of the engine block and supply the exterior air to the throttle body. Thereby, it is possible to prevent a size of an apparatus main body (particularly, a size in a vertical direction) from being enlarged. Also, the intake duct and the intake manifold which is configured to overlap with the cylinder in the engine in the right and left direction of the outboard motor are arranged parallel to each other and side by side in the vertical direction. For this reason, it is possible to arrange the intake duct apart from the cylinder of high temperatures. Thereby, it is possible to prevent the exterior air circulating through the intake duct from being warmed up due to the heat generated from the cylinder. As a result, it is possible to improve the intake packing efficiency of the engine by the exterior air without enlarging the apparatus main body.

In the above intake apparatus, it is preferable that a resonator chamber configured to communicate with an intake passage of the intake duct to reduce an intake noise is provided, and the resonator chamber is arranged below the intake duct and side by side in the vertical direction between the intake duct and the intake manifold. In this case, it is possible to use the resonator chamber as a shield member of the heat generated from the cylinder. Thereby, it is possible to further improve the intake packing efficiency of the engine by the exterior air.

In the above intake apparatus, it is preferable that a combined body in which the intake duct and the resonator chamber are integrally combined is formed by coupling a first member and a second member each of which has a part of a space formed in the intake duct and the resonator chamber, and at least one of the first member and the second member is formed with a communication passage configured to communicate the intake duct with the resonator chamber. In this case, the intake duct and the resonator chamber are integrally combined. For this reason, it is possible to reduce the constitutional components of the intake apparatus and to miniaturize the apparatus main body. Also, the combined body is formed by coupling the first and second members each of which has a part of the space formed in the intake duct and the resonator chamber. For this reason, it is possible to manufacture the combined body of the intake duct and the resonator chamber without performing complicated processing. Thereby, it is possible to reduce the overall manufacturing cost of the intake apparatus.

According to the aspects of the embodiments of the present invention, it is possible to suppress the intake noise and to effectively prevent the entry of the water into the engine without enlarging the apparatus main body.

According to the aspects of the embodiments of the present invention, it is also possible to improve the intake packing efficiency of the engine by the exterior air without enlarging the apparatus main body.

DETAILED DESCRIPTION OF THE EMBODIMENTS

Figure 1A:
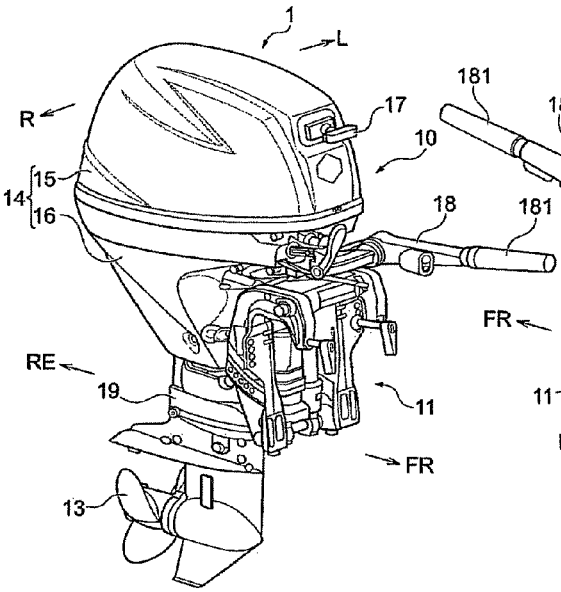
FIGS. 1A and 1B are overall perspective views of an outboard motor to which an intake apparatus of an engine for an outboard motor according to an illustrative embodiment is applied.
Figure 1B:
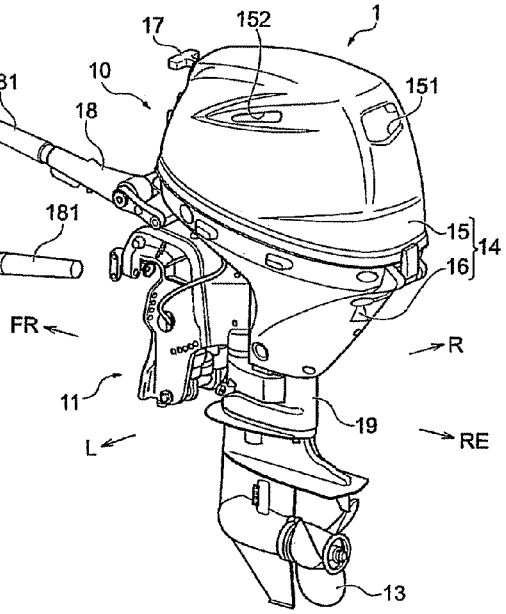

Hereinafter, an illustrative embodiment of the present invention will be described in detail with reference to the accompanying drawings. First, a schematic configuration of an outboard motor to which an intake apparatus of an engine for an outboard motor (hereinafter, simply referred to as 'intake apparatus') according to the illustrative embodiment is applied is described. FIGS. 1A and 1B are overall perspective views of an outboard motor to which the intake apparatus according to the illustrative embodiment is applied. Meanwhile, in the drawings, for convenience of explanations, a front of the outboard motor is denoted with an arrow FR, a rear of the outboard motor is denoted with an arrow RE, a left direction of the outboard motor is denoted with an arrow L and a right direction of the outboard motor is denoted with an arrow R. In FIG. 1A, the outboard motor of the illustrative embodiment is shown as seen from the right-front side. In FIG. 1B, the outboard motor is shown as seen from the left-rear side.

As shown in FIGS. 1A and 1B, an outboard motor 1 of the illustrative embodiment is provided with an outboard motor main body 10 and a bracket device 11 for attaching the outboard motor main body 10 to a stern part (not shown) of a hull. The outboard motor main body 10 has an engine cover 14 provided at an upper part of the main body and a body part 19 provided below the engine cover 14. The engine cover 14 is configured by an upper cover 15 and a lower cover 16. A propeller 13 is provided in the vicinity of a lower end portion of the body part 19. The bracket device 11 is arranged at the front of the lower cover 16 and the body part 19.

The upper cover 15 has a substantially downwardly opening shape. On the other hand, the lower cover 16 has a substantially upwardly opening shape. By combining the upper cover 15 and the lower cover 16, an engine room that will be described later is formed in the outboard motor main body 10. As specifically described later, an engine 12, an intake apparatus 2 and a variety of electric components are accommodated in the engine room. In the meantime, a seal member (not shown) is arranged on a mating surface of the upper cover 15 and the lower cover 16. The seal member has a substantially annular shape and prevents entry of water such as ocean water from the mating surface of the upper cover 15 and the lower cover 16.

A lever 17 for a recoil starter (not shown) for activating the engine 12 is provided at a front side of the upper cover 15 with protruding towards the front of the outboard motor 1. When the lever 17 is pulled, the engine 12 is activated. Also, as shown in FIG. 1B, an intake introduction port 151 for introducing an air for combustion of the engine 12 is provided at a rear side of the upper cover 15. Further, an exhaust port 152 for exhausting an air for ventilation in the engine cover 14 to an outside is provided in the vicinity of an upper end portion of a left side surface of the upper cover 15.

A tiller handle 18 protruding towards the front of the outboard motor 1 is provided at the front of the lower cover 16 and above the bracket device 11. The tiller handle 18 is configured to pivot the outboard motor main body 10 in the vertical and right and left directions at a stern part functioning as a support point, to which the bracket device 11 is fixed. A throttle grip 181 is attached to a tip of the tiller handle 18. The throttle grip 181 is rotatably attached around a shaft of the tiller handle 18. An opening degree of a throttle valve (not shown) is adjusted depending on a rotating amount of the throttle grip 181. Thereby, it is possible to control a speed and acceleration/deceleration of the hull.

A drive shaft (not shown) extending in the vertical direction is arranged at the outboard motor main body 10. A power conversion mechanism is provided at a lower end portion of the drive shaft. The engine 12 is coupled to the propeller 13 through the drive shaft and the conversion mechanism. The outboard motor 1 converts a driving force of the engine 12 into a rotating force of the propeller 13 to obtain a propulsion force by the drive shaft and the conversion mechanism.

Figure 2:
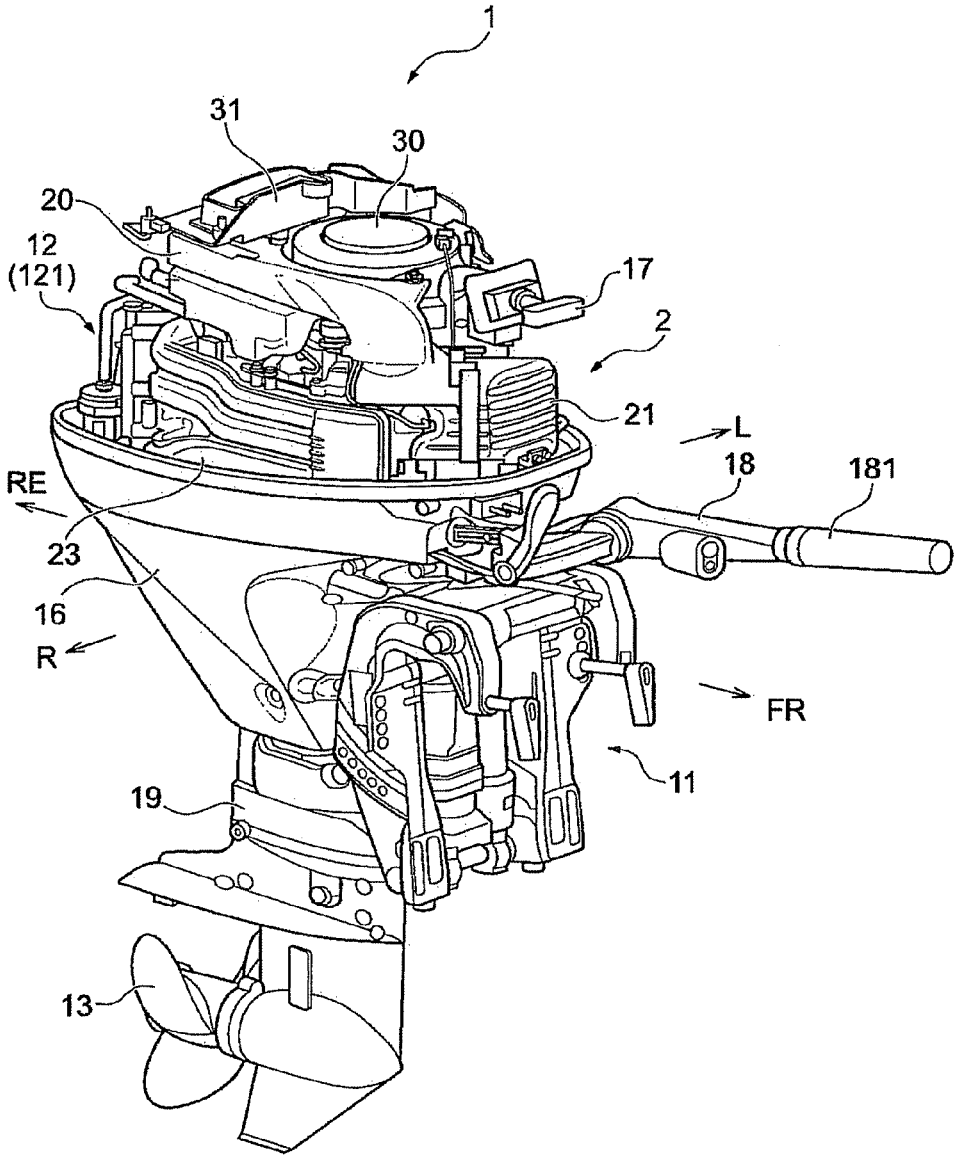
FIG. 2 is a perspective view of the outboard motor of which an upper cover is detached from a state shown in FIG. 1A.
Figure 3:
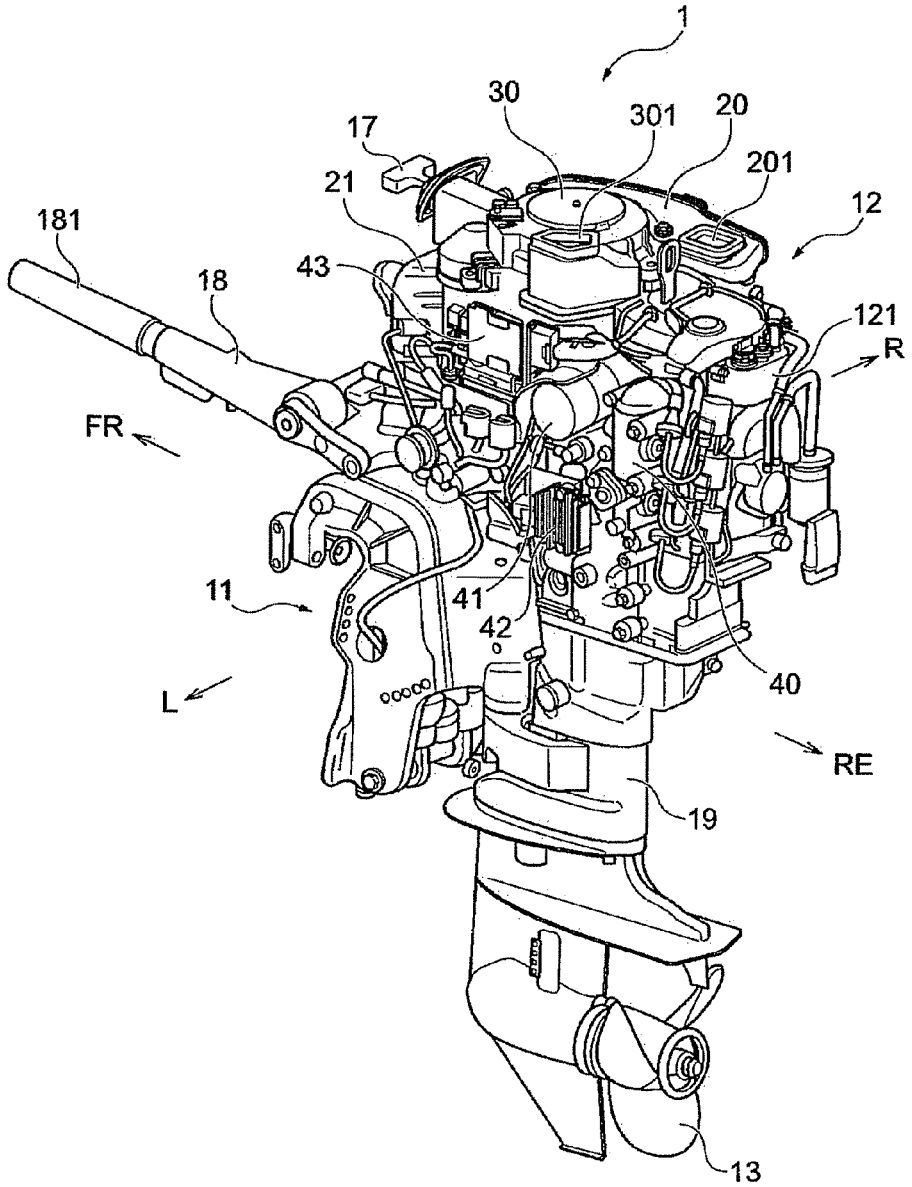
FIG. 3 is a perspective view of the outboard motor of which an engine cover is detached from a state shown in FIG. 1B.

Subsequently, an interval configuration of the engine cover 14 is described with reference to FIGS. 2 and 3. FIG. 2 is a perspective view of the outboard motor 1 of which the upper cover 15 is detached from a state shown in FIG. 1A. FIG. 3 is a perspective view of the outboard motor 1 of which the engine cover 14 (the upper cover 15 and the lower cover 16) is detached from a state shown in FIG. 1B. Meanwhile, in FIG. 2, a guide member 31 configuring a part of the upper cover 15 is shown for convenience of explanations.

As shown in FIGS. 2 and 3, the engine 12 is accommodated in the engine room of the outboard motor main body 10 (more specifically, the engine cover 14). The engine 12 is configured by a multi-cylinder engine, for example. In this illustrative embodiment, an engine block 121 configuring a part of the engine 12 is configured such that an axial direction of a cylinder (not shown) coincides with the front and rear direction of the outboard motor 1.

The intake apparatus 2 is provided at the right side of the engine block 121 (refer to FIG. 2). The intake apparatus 2 is configured to supply an exterior air, which is introduced from the intake introduction port 151 of the upper cover 15, into a combustion chamber in the engine 12. Particularly, the intake apparatus 2 is configured to separate the water contained in the exterior air while suppressing an increase in a temperature of the exterior air flowing in the apparatus. The intake apparatus 2 is provided with an intake duct 20, an intake silencer box 21, a throttle body 22 (refer to FIGS. 5A and 5B) and an intake manifold 23. As shown in FIG. 2, the intake duct 20 and the intake silencer box 21 are arranged at positions at which they are entirely exposed at a state where the upper cover 15 is detached. The intake manifold 23 is arranged at a position at which a part of a lower end portion thereof faces a part of the lower cover 16. In the meantime, the detailed configuration of the intake apparatus 2 will be described later.

An exhaust-system component, an oil filter 41 and a variety of electric components are intensively arranged at a left side of the engine block 121. For example, an exhaust manifold 40, which is an exhaust-system component, is provided on a left surface of the engine block 121. The exhaust manifold 40 extends downwardly. An exhaust gas generated in the engine 12 is exhausted from a vicinity of a lower end portion of the outboard motor main body 10 (more specifically, the body part 19) through the exhaust manifold 40. Also, a regulator 42 for adjusting a pressure of the engine and an engine control unit 43, which are the electric components, are provided on the left surface of the engine block 121. In the meantime, the oil filter 41 is arranged at a position at which it is entirely exposed at the state where the upper cover 15 is detached.

The engine 12 is provided at its upper part with the recoil starter for activating the engine 12 with being covered by a recoil starter cover 30. The lever 17 is provided at the front of the recoil starter. The lever 17 is coupled to the recoil starter through a rope (not shown). When the rope is pulled with the lever 17 being gripped, the rotating force is transmitted to the recoil starter. The rotating force of the recoil starter is transmitted to a crankshaft (not shown) of the engine 12. Thereby, the engine 12 is activated.

The guide member 31 for intake in the engine 12 and exhaust in the engine cover 14 is arranged above the recoil starter cover 30. In this illustrative embodiment, the guide member 31 is fixed at the inside of the upper cover 15. In FIG. 2, only the guide member 31 is shown above the recoil starter cover 30, for convenience of explanations.

Figure 4:
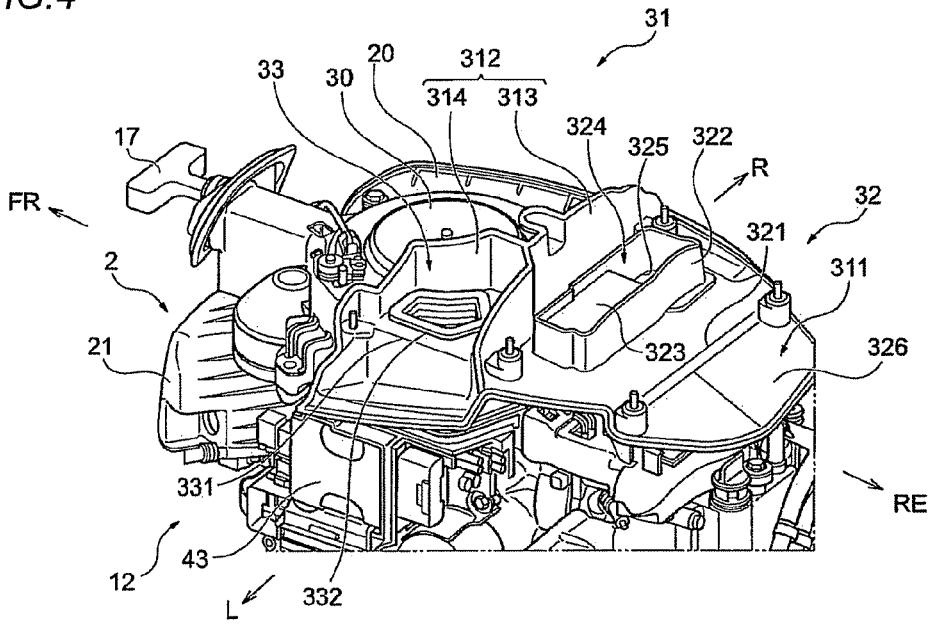
FIG. 4 is an enlarged view of a vicinity of a guide member provided for the outboard motor according to the illustrative embodiment.

Here, the configuration of the guide member 31 is described with reference to FIG. 4. FIG. 4 is a partially enlarged view of a vicinity of the guide member 31 provided for the outboard motor 1 according to the illustrative embodiment. Meanwhile, in FIG. 4, the outboard motor 1 is shown from the left-rear side. Also, in FIG. 4, the guide member 31 fixed to the upper cover 15 is shown above the engine 12, like FIG. 2.

As shown in FIG. 4, the guide member 31 is arranged to face a part of the rear side of the outboard motor 1 above the engine 12. The guide member 31 has a bottom wall part 311 configured to cover parts of the intake duct 20 and the recoil starter cover 30. A side edge part of the bottom wall part 311 has a shape corresponding to a shape of an inner wall surface (a sidewall surface) of the upper cover 15. Also, the bottom wall part 311 is provided thereon with a partition wall 312 upstanding upwardly from a surface of the bottom wall part 311. The partition wall 312 has a first partition wall 313 extending in the right and left direction of the outboard motor 1 and a second partition wall 314 extending in a left-front direction from a center of the first partition wall 313. Upper end portions of the first partition wall 313 and the second partition wall 314 have shapes corresponding to a shape of an inner wall surface (an upper wall surface) of the upper cover. Therefore, a pair of partitioned spaces is formed between the upper cover 15 and the guide member 31 at a state where the guide member 31 is fixed to the upper cover 15. An intake guide part 32 is configured by the space formed at the rear of the first partition wall 313. On the other hand, an exhaust guide part 33 is configured by the space formed between the first partition wall 313 and the second partition wall 314. The intake guide part 32 communicates with the intake introduction port 151. The exhaust guide part 33 communicates with the exhaust port 152.

The bottom wall part 311 of the intake guide part 32 is provided with a step part 321. The bottom wall part 311 is configured so that a part of a front side of the step part 321 is higher than a part of a rear side thereof. The bottom wall part 311 is provided at the front side of the step part 321 with a cylindrical upstanding wall part 322 having a rectangular shape as seen from above. The upstanding wall part 322 functions as a first water separation part. In the upstanding wall part 322, a bottom part 323 is provided at a left side. On the other hand, a through-hole 324 is provided at a right side of the upstanding wall part 322. An opening 325 is formed at a part of the bottom wall part 311 corresponding to the through-hole 324. At the state where the guide member 31 is fixed to the upper cover 15, the opening 325 is coupled to an opening 201 (refer to FIG. 3) of the intake duct 20, which will be described later. Also, the bottom wall part 311 is provided at a rear side of the step part 321 with an inclined part 326 descending towards the rear. An upper surface of a rear end portion of the inclined part 326 is arranged to be substantially flush with a part of the upper cover 15 defining the lower end portion of the intake introduction port 151.

In the meantime, the bottom wall part 311 of the exhaust guide part 33 is provided with a step part 331. The bottom wall part 311 is configured so that a part of an inner side of the step part 331 is higher than a part of an outer side thereof. The bottom wall part 311 is formed with an opening 332 at the inner side of the step part 331. At the state where the guide member 31 is fixed to the upper cover 15, the opening 332 is coupled to an opening 301 (refer to FIG. 3) of the recoil starter cover 30, which will be described later.

According to the guide member 31 configured as described above, the exterior air introduced from the intake introduction port 151 of the upper cover 15 (refer to FIGS. 1A and 1B) is introduced into the intake duct 20 via the bottom wall part 311 and partition wall 312 (the first partition wall 313) of the intake guide part 32 and the through-hole 324 of the upstanding wall part 322. Also, the water such as ocean water introduced into the intake guide part 32 is separated by the upstanding wall part 322 standing on the bottom wall part 311. Then, the exterior air is exhausted from the intake introduction port 151 to the outside through the bottom wall part 311 and inclined part 326 of the intake guide part 32. In the meantime, the air for ventilation circulating in the engine cover 14 and introduced into the recoil starter cover 30 is delivered to the exhaust guide part 33 through the opening 301. Then, the air for ventilation is exhausted from the exhaust port 152 of the upper cover 15 to the outside via the bottom wall part 311 and partition wall 312 (the first partition wall 313 and the second partition wall 314) of the exhaust guide part 33.

Figure 5A:
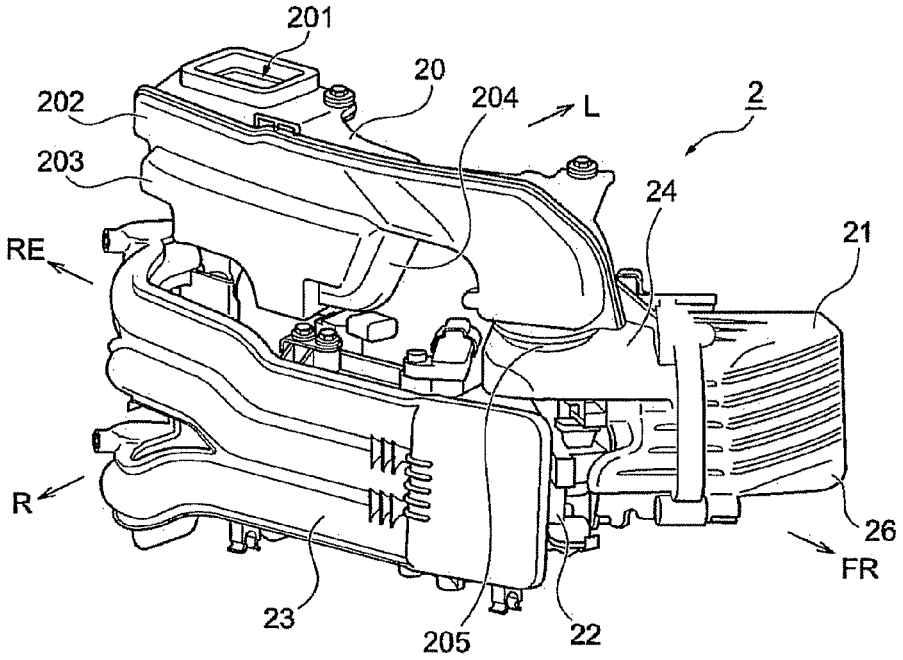
FIGS. 5A and 5B illustrate a configuration of the intake apparatus of the illustrative embodiment.
Figure 5B:
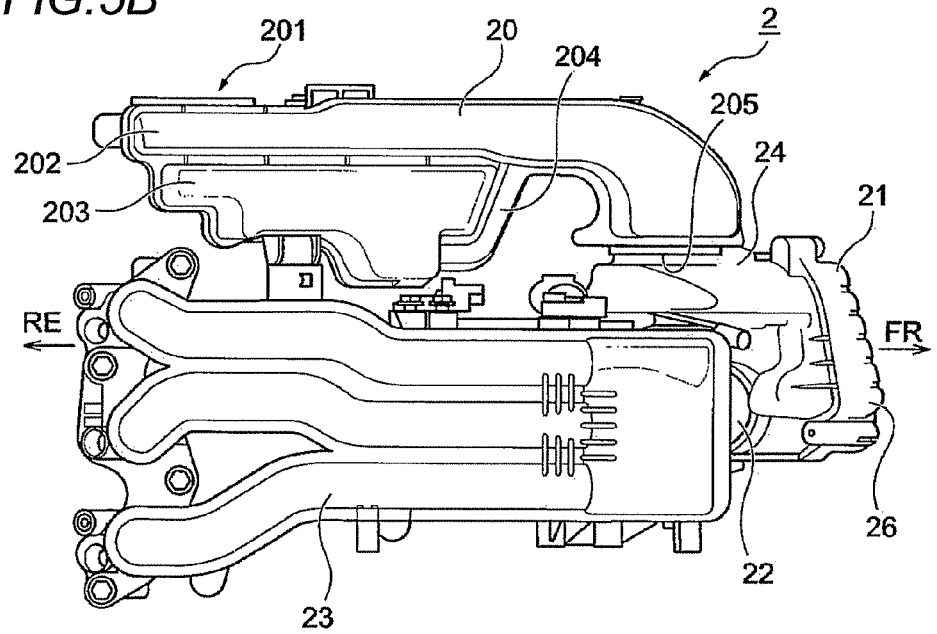

Subsequently, the configuration of the intake apparatus 2 according to this illustrative embodiment is described with reference to FIGS. 5A and 5B. FIGS. 5A and 5B illustrate the configuration of the intake apparatus 2 of the illustrative embodiment. FIGS. 5A and 5B are a perspective view and a side view of the intake apparatus 2, respectively. Meanwhile, FIGS. 5A and 5B show a configuration example of the intake apparatus 2 of the present invention and the constitutional elements are not limited thereto. For example, the intake apparatus 2 of the present invention can include only a part of the constitutional elements shown in FIGS. 5A and 5B. Also, the intake apparatus 2 of the present invention can include a part (for example, the upstanding wall part 322) of the guide member 31 fixed to the upper cover 15, in addition to the constitutional elements shown in FIGS. 5A and 5B.

As shown in FIGS. 5A and 5B, the intake apparatus 2 is provided with the intake manifold 23, the throttle body 22 coupled to an upstream end side of the intake manifold 23, the intake silencer box 21 coupled to an upstream end side of the throttle body 22 and the intake duct 20 coupled to an upstream end of the intake silencer box 21. The opening 201 of the intake duct 20 is configured to communicate with the intake introduction port 151 (refer to FIGS. 1A and 1B) provided at the upper part of the upper cover 15 (refer to FIGS. 1A and 1B) through the intake guide part 32 (refer to FIG. 4). That is, the intake apparatus 2 has the intake duct 20 communicating the intake introduction port 151 with the intake silencer box 21 to have the configuration where the exterior air can be directly introduced.

In the intake duct 20, a cylindrical duct part 202 extending in the front and rear direction of the outboard motor 1 and a resonator chamber part (hereinafter, simply referred to as 'resonator part') 203 provided below the duct part 202 and having a predetermined volume communicate with each other by a communication passage 204 to form the intake duct 20. An upstream end of the duct part 202 is provided with the opening 201 opening upwards. A downstream end of the duct part 202 is provided with a coupling part 205 coupled to the intake silencer box 21. The intake duct 20 is configured to secure a flow path of an air for combustion by the duct part 202 and to reduce a noise (an intake noise) upon the intake by the resonator part 203.

The intake silencer box 21 is provided with a main body part 24 coupled at its upstream end to the intake duct 20 and at its downstream end to the throttle body 22 and a cover part 26 detachably mounted to the main body part 24. The intake silencer box 21 is provided therein with an air filter element 27 (refer to FIGS. 8A and 8B). The intake silencer box 21 is configured to reduce the noise upon the intake and to capture the water in the air for combustion.

The throttle body 22 is provided therein with a throttle valve (not shown). An opening degree of the throttle valve is adjusted depending on the rotating amount of the throttle grip 181 (refer to FIGS. 1A and 1B). Thereby, an amount of the air for combustion to be introduced into the engine 12 is adjusted.

The intake manifold 23 is branched into a plurality of flow paths (three flow paths, in this illustrative embodiment) towards the rear of the outboard motor 1 from the upstream end thereof to which the throttle body 22 is coupled. The plurality of flow paths is respectively coupled to each intake port (not shown) of the engine block 121.

As shown in FIG. 5B, in the intake apparatus 2, the duct part 202 of the intake duct 20 and the intake manifold 23 are arranged parallel to each other and side by side in the vertical direction. In general, the intake manifold 23 is arranged to overlap with the cylinder in the engine 12 in the right and left direction of the outboard motor 1. As the duct part 202 and the intake manifold 23 are arranged parallel to each other and side by side in the vertical direction, the duct part 202 is arranged with being spaced from the cylinder of high temperatures. For this reason, the air for combustion flowing in the duct part 202 is prevented from being warmed up due to the heat generated from the cylinder.

Also, the intake duct 20 is provided with the resonator part 203 below the duct part 202. That is, the resonator part 203 is arranged between the duct part 202 and the intake manifold 23. By such arrangement, the resonator part 203 can be used as a shield member of the heat generated from the cylinder.

According to the intake apparatus 2 configured as described above, the air for combustion introduced from the opening 201 of the intake duct 20 passes through the intake silencer box 21 from the duct part 202 in the intake duct 20, passes through the throttle body 22 and the intake manifold 23 and is then supplied into the engine 12. As described above, the noise upon the intake is reduced by the resonator part 203 of the intake duct 20 and the intake silencer box 21. In the intake apparatus 2, the intake duct 20 and the intake silencer box 21 configure a silence assembly. Also, the water contained in the air for combustion is separated while the air passes through the intake duct 20 and the intake silencer box 21. Also, the water contained in the air for combustion is further removed by the air filter element 27. In this way, it is possible to prevent the entry of the water into the engine 12.

Figure 6A:
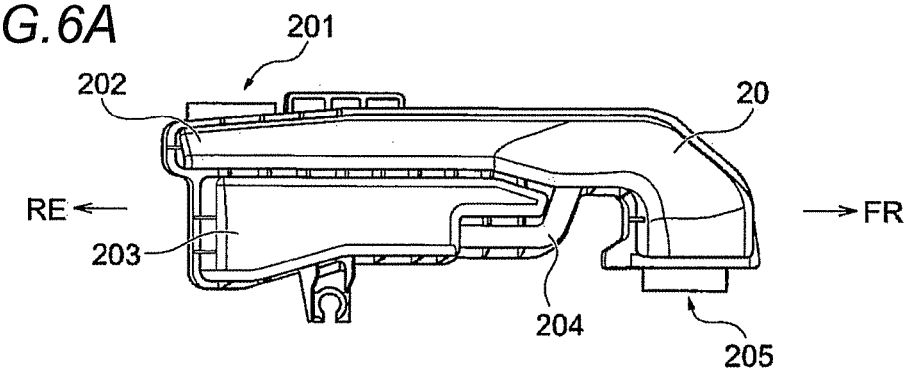
FIGS. 6A to 6D illustrate an intake duct provided for the intake apparatus of the illustrative embodiment.
Figure 6B:
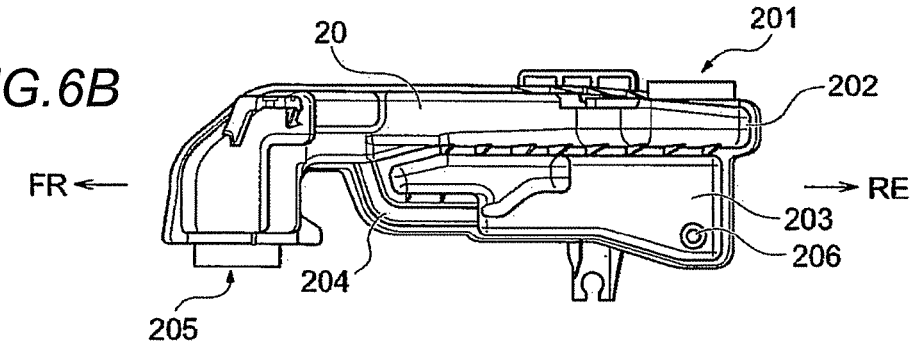
Figure 6C:
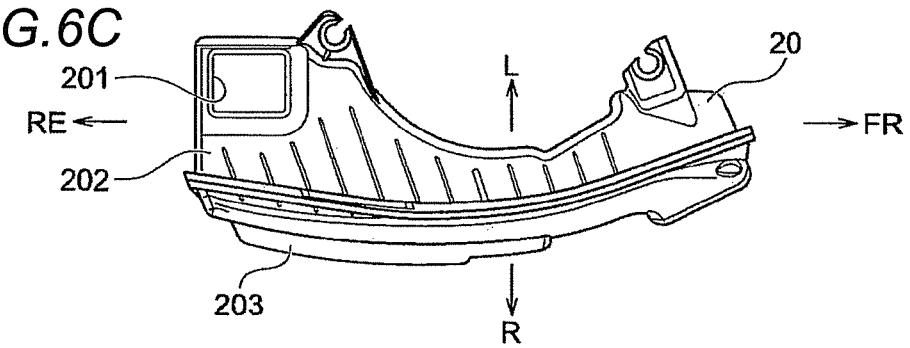
Figure 6D:
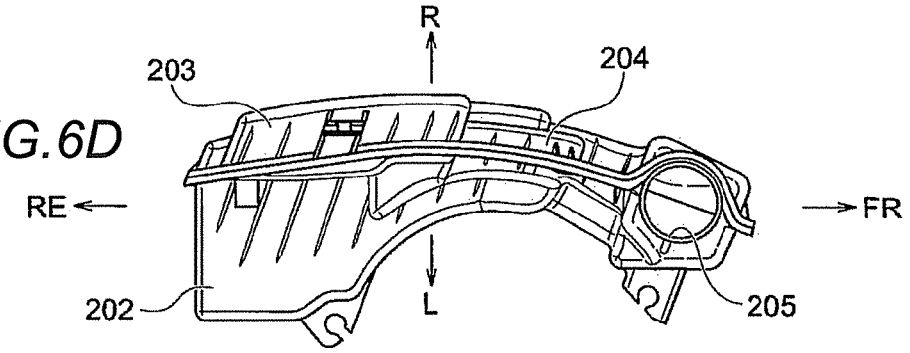
Figure 7A:
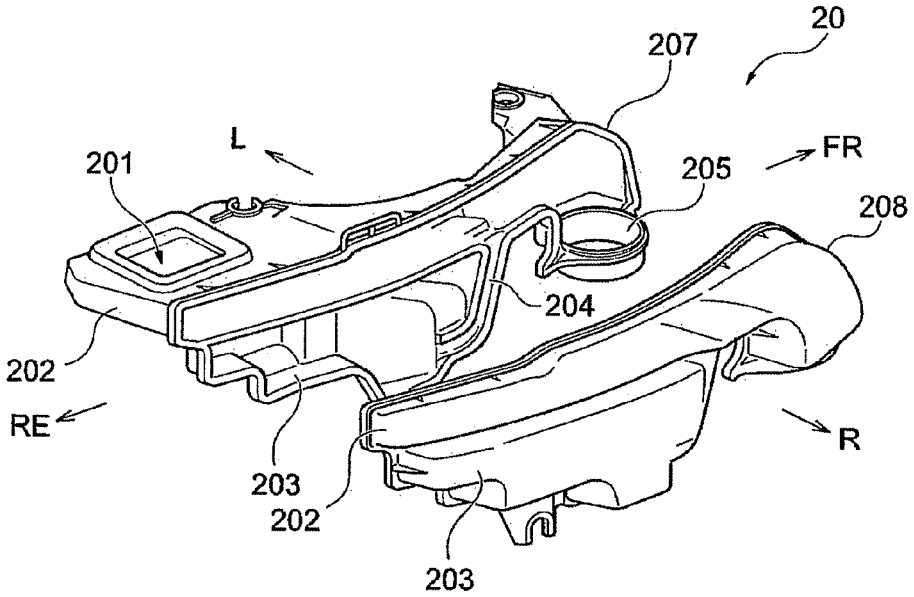
FIGS. 7A and 7B are exploded perspective views of the intake duct provided for the intake apparatus of the illustrative embodiment.
Figure 7B:
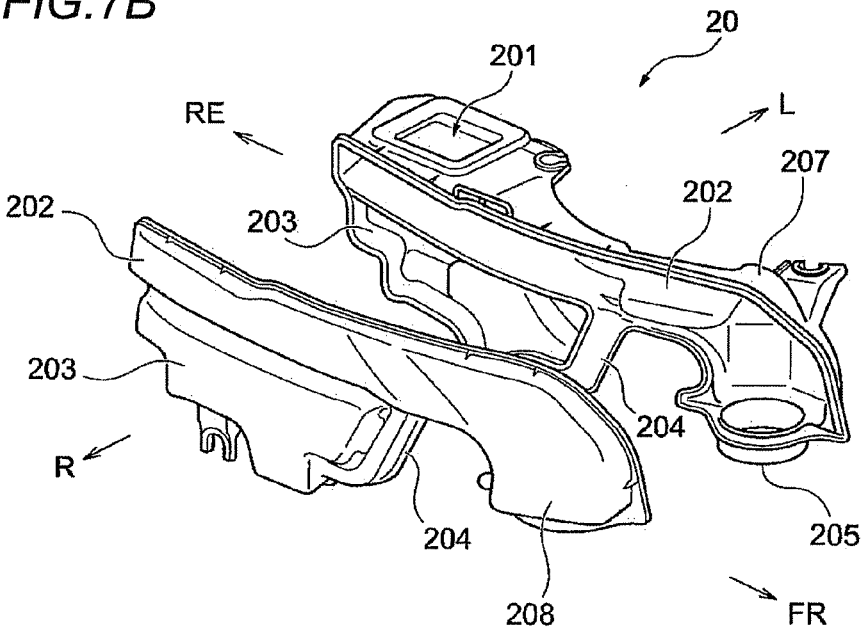

In the below, the intake duct 20 of the intake apparatus 2 according to the illustrative embodiment is described in detail with reference to FIGS. 6A to 6D and FIGS. 7A and 7B. FIGS. 6A to 6D illustrate the intake duct 20 provided for the intake apparatus 2 of the illustrative embodiment. FIGS. 6A and 6B are a left side view and a right side view of the intake duct 20, respectively. Also, FIGS. 6C and 6D are a plan view and a bottom view of the intake duct 20, respectively. FIGS. 7A and 7B are exploded perspective views of the intake duct 20 provided for the intake apparatus 2 of the illustrative embodiment. In FIG. 7A, the intake duct 20 is shown as seen from the right-rear side, and in FIG. 7B, the intake duct 20 is shown as seen from the right-front side.

As shown in FIGS. 6A to 6D, the duct part 202 has a shape extending in the front and rear direction of the outboard motor 1 at the upper side of the intake duct 20 and bent downwardly at a front-side end thereof (refer to FIGS. 6A and 6B). Also, the duct part 202 is configured so that a size in a width direction (the right and left direction of the outboard motor 1) is larger in the vicinity of a rear end portion than in the vicinity of a front end portion (refer to FIGS. 6C and 6D). The rectangular opening 201 is provided at an upper surface part in the vicinity of the rear end portion of the duct part 202. In the meantime, the circular coupling part 205 is provided at a lower surface part in the vicinity of the front end portion of the duct part 202. The air for combustion (the exterior air) introduced from the opening 201 flows in the duct part 202 from the rear side of the outboard motor 1 towards the front side thereof and changes the flowing direction thereof towards the lower side at the front end portion of the duct part 202.

The resonator part 203 is arranged below the duct part 202 (refer to FIGS. 6A and 6B). Also, the resonator part 203 is arranged in an area that is at the rear side of the duct part 202 and is a part of the right side of the intake duct 20 (refer to FIGS. 6C and 6D). The resonator part 203 has a shape extending in the front and rear direction of the outboard motor 1 below the intake duct 20. The resonator part 203 consists of an air chamber having a predetermined volume. The resonator part 203 is configured to reduce the intake noise by using a resonance effect. A bottom part (more specifically, a lower end of the rear end portion) of the resonator part 203 is provided with a drain hole 206. A bottom wall surface of the resonator part 203 has a shape descending downwardly so as to guide the water collected in the resonator part 203 to the drain hole 206.

The communication passage 204 has a shape extending from a lower part in the vicinity of the front end portion of the duct part 202, bent rearwards and coupled to a front surface part of the resonator part 203. That is, the communication passage 204 has one end (a front end) coupled to the lower part in the vicinity of the front end portion of the duct part 202 and the other end (a rear end) coupled to the front surface part of the resonator part 203.

According to the intake duct 20 configured as described above, a part of the air for combustion (the exterior air) flowing through the duct part 202 is introduced into the resonator part 203 through the communication passage 204. The air for combustion introduced into the resonator part 203 is reversed at an inner wall part (particularly, an inner wall part of the rear side) and is returned to the duct part 202 from the resonator part 203 through the communication passage 204. The air for combustion having returned to the duct part 202 interferes with the air for combustion directly flowing in the duct part 202. By the interference of the airs for combustion, the noise upon the intake is reduced.

In particular, the intake duct 20 is formed with an intake passage in the duct part 202 so that the air for combustion from the intake introduction port 151 flows from the rear side of the outboard motor 1 towards the front side thereof. For this reason, it is possible to secure a length of the duct part 202 in the front and rear direction of the outboard motor 1. Also, the resonator part 203 is provided in communication with the duct part 202. Thereby, as compared to a configuration where the length of the intake passage of the intake duct 20 cannot be secured, it is possible to secure a degree of design freedom as regards the volume of the resonator part 203. As a result, it is possible to selectively reduce the intake noise having a desired frequency.

Also, the water contained in the air for combustion introduced into the resonator part 203 is separated when the air for combustion collides with the inner wall part and is thus reversed. The water separated in the resonator part 203 is guided to the drain hole 206 via the bottom wall surface of the resonator part 203. Then, the water is discharged to the outside of the intake duct 20 from the drain hole 206. That is, the resonator part 203 of the intake duct 20 functions as a separation part (a second water separation part) configured to separate the water from the air for combustion (the exterior air) introduced into the duct unit 202.

As shown in FIGS. 7A and 7B, the intake duct 20 configured as described above is formed by coupling a pair of a first member 207 and a second member 208, which are divided in the right and left direction of the outboard motor 1. For example, the first member 207 and the second member 208 are formed by injecting a resin material into a mold. Each of the first member 207 and the second member 208 has a part of the space formed in the intake duct 20 (i.e., the space configuring the duct unit 202, the resonator part 203 and the communication passage 204). The intake duct 20 is formed by coupling the first member 207 and the second member 208 so as to connect the spaces formed in the first member 207 and the second member 208.

Like this, in this illustrative embodiment, the intake duct 20 is formed by coupling the first member 207 and the second member 208 each of which has a part of the space formed in the intake duct 20 (i.e., the space configuring the duct unit 202, the resonator part 203 and the communication passage 204). For this reason, it is possible to manufacture the intake duct 20 without performing complicated processing. Thereby, it is possible to reduce the cost necessary to manufacture the intake duct 20, so that it is also possible to reduce the overall manufacturing cost of the intake apparatus 2.

Figure 8A:
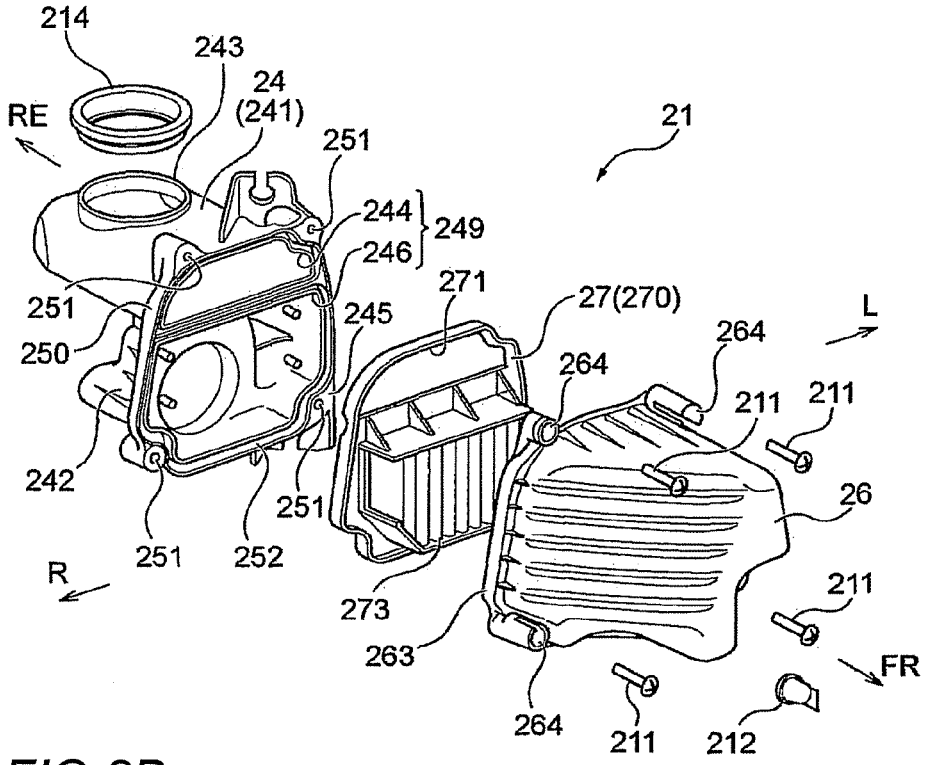
FIGS. 8A and 8B are exploded perspective views of an intake silencer box provided for the intake apparatus of the illustrative embodiment.
Figure 8B:
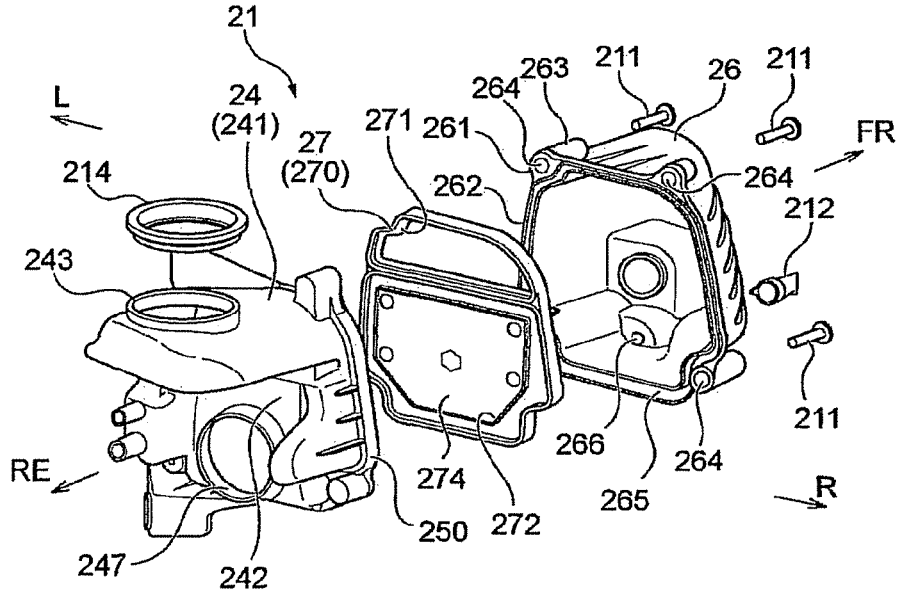

Subsequently, the configuration of the intake silencer box 21 provided for the intake apparatus 2 of the illustrative embodiment is described in detail with reference to FIGS. 8A and 8B. FIGS. 8A and 8B are exploded perspective views of the intake silencer box 21 provided for the intake apparatus 2 of the illustrative embodiment. In FIG. 8A, the intake silencer box 21 is shown as seen from the right-front side, and in FIG. 8B, the intake silencer box 21 is shown as seen from the right-rear side.

As shown in FIGS. 8A and 8B, the intake silencer box 21 is formed by dividing one box body into the main body part 24 and the cover part 26. Also, the intake silencer box 21 has the air filter element 27 on the mating surface of the main body part 24 and the cover part 26. The air filter element 27 is sandwiched and fixed by the main body part 24 and the cover part 26. The cover part 26 is detachably mounted to the main body part 24. When the cover part 26 is detached from the main body part 24, the air filter element 27 is exposed to the outside. Thereby, it is possible to replace the air filter element 27. When the air filter element 27 is detached, the interior of the main body part 24 is exposed.

The main body part 24 has a duct part 241 configured to guide the air for combustion towards the cover part 26 and a guide part 242 configured to guide the air for combustion from the cover part 26 towards the throttle body 22 (refer to FIGS. 5A and 5B). The duct part 241 and the guide part 242 are provided side by side in the vertical direction. The duct part 241 has a substantially rectangular shape as seen from a sectional view and extends in a cylinder shape from an upstream side towards a downstream side. An upstream end of the duct part 241 is a coupling part 243 opening upwards and coupled to the intake duct 20. A downstream end of the duct part 241 is an opening 244 opening on the mating surface 245 with the cover part 26 and having a rectangular shape as seen from the front. The guide part 242 has a cylinder shape extending rearwards from the mating surface 245 with the cover part 26. An upstream end of the guide part 242 is an opening 246 opening on the mating surface 245 with the cover part 26 and having a rectangular shape as seen from the front. A downstream end of the guide part 242 is a coupling part 247 coupled to the throttle body 22.

As described above, the opening 244 of the duct part 241 and the opening 246 of the guide part 242 are provided on the mating surface 245 with the cover part 26. The opening 244 and the opening 246 are combined to configure an opening 249 of the main body part 24. An outer periphery of the opening 249 is formed with a flange part 250 so as to secure the mating surface 245 with the cover part 26. Four corners of the flange part 250 are formed with bolt holes 251 for fixing the cover part 26. Also, the mating surface 245 is formed with an annular recess 252 conforming to an outer shape of the opening 249. The annular recess 252 is configured so that a frame 270 of the air filter element 27, which will be described later, is fitted therein.

The cover part 26 has a substantially triangular box shape as seen from above having an opening 262 on a mating surface 261 with the main body part 24. An outer periphery of the opening 262 is formed with a flange part 263 so as to secure the mating surface 261 with the main body part 24. Four corners of the flange part 263 are formed with attachment holes 264 for attaching bolts 211 thereto, in correspondence to the bolt holes 251 of the main body part 24. By the bolts 211, the main body part 24 and the cover part 26 are fixed. Also, the mating surface 261 is formed with an annular recess 265 conforming to an outer diameter of the opening 262. A drain hole 266 is formed on an inner wall surface of the front side of the cover part 26 in the vicinity of the lower end portion thereof. The drain hole 266 is configured to drain the water collected in the cover part 26 to the outside. A drain cap 212 is attached to the drain hole 266. The drain cap 212 is provided with one way valve in the draining direction, so that it is possible to drain the water collected in the cover part 26 to the outside. That is, the cover part 26 functions as a separation part (a third water separation part) configured to separate the water contained in the air for combustion flowing in the intake silencer box 21.

The air filter element 27 has the frame 270 conforming to outer shapes of the openings 244, 246. The frame 270 is formed with openings 271, 272, in correspondence to the openings 244, 246. In the opening 272, a filter part 273 having a substantially trapezoidal shape as seen from the front is provided at a surface-side (the cover part 26-side) of the frame 270. The opening 272 is blocked by the filter part 273. The filter part 273 is configured by a non-woven fabric formed of a water-shedding fabric. The filter part 273 is configured by the non-woven fabric, so that the noise performance of a high frequency region is improved upon the intake.

A backside (the main body part 24-side) of the frame 270 is provided with a substantially trapezoidal frame arrester 274 as seen from the front so as to cover the opening 272. The frame arrester 274 is formed of a plate material such as punching metal. The frame arrester 274 is configured to interrupt propagation of flame flowing back while securing the ventilation of the air filter element 27.

When assembling the intake silencer box 21, the air filter element 27 is first interposed between the main body part 24 and the cover part 26. Then, the frame 270 of the air filter element 27 is fitted into the annular recess 252 of the main body part 24 and the annular recess 265 of the cover part 26. Then, the main body part 24 and the cover part 26 are fastened by the bolts 211. Thereby, the air filter element 27 is sandwiched and fixed by the main body part 24 and the cover part 26. In this way, the intake silencer box 21 is assembled.

The intake silencer box 21 assembled as described above is fixed at a predetermined position in the engine cover 14, as the intake duct 20 is coupled to the coupling part 243 at the upstream end side through the annular seal member 214 and the throttle body 22 is coupled to the coupling part 247 at the downstream end side through the seal member (not shown). At this time, the intake silencer box 21 is arranged to be higher than the mating surface of the upper cover 15 and the lower cover 16 (refer to FIGS. 1A, 1B and 2). Also, the opening 249 of the intake silencer box 21 is faced towards the front of the outboard motor 1. At this time, the air filter element 27 is arranged along a plane orthogonal to the front and rear direction of the outboard motor 1 at the front-side part of the outboard motor 1 and at the front of the engine block 121 (refer to FIGS. 2 and 3).

When making a maintenance for the intake silencer box 21, the upper cover 15 (refer to FIGS. 1A and 1B) is first detached. Thereby, the intake silencer box 21 is exposed to the outside. Then, the cover part 26 is detached from the main body part 24. In this case, it is possible to detach only the cover part 26 without detaching the main body part 24 from the intake duct 20. When the cover part 26 is detached, the air filter element 27 is exposed to the front of the outboard motor 1. Like this, the interior of the intake silencer box 21 is exposed just by detaching the upper cover 15 and the main body part 24. For this reason, a passenger can easily check a status of the air filter element 27 from the rear of the hull. Also, it is possible to easily replace the air filter element 27. As a result, the maintenance characteristic of the intake silencer box 21 is improved.

Figure 9A:
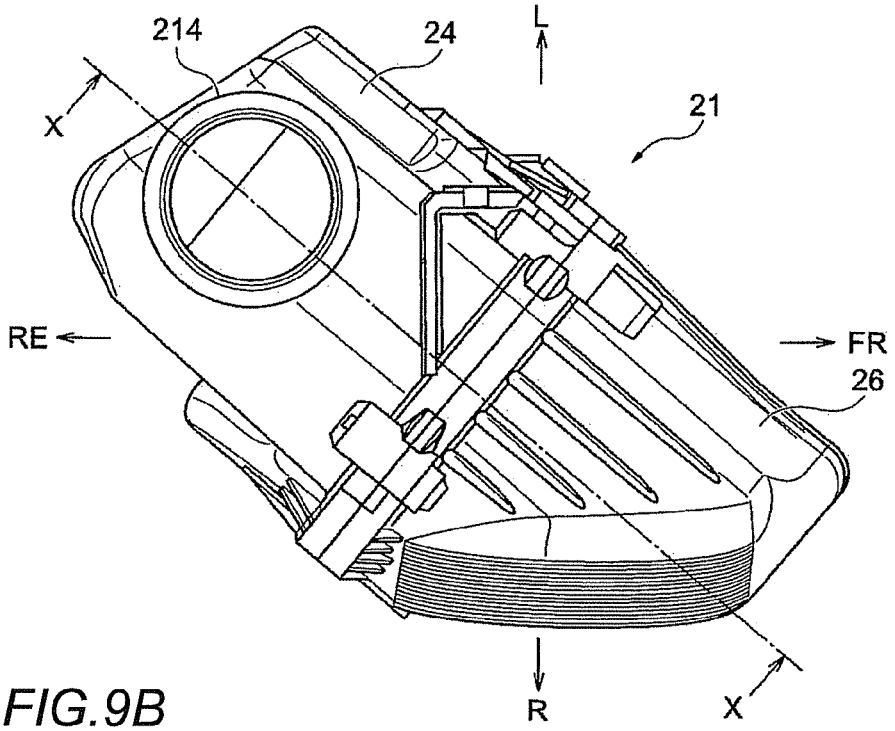
FIGS. 9A and 9B are detailed views of the intake silencer box provided for the intake apparatus of the illustrative embodiment.
Figure 9B:
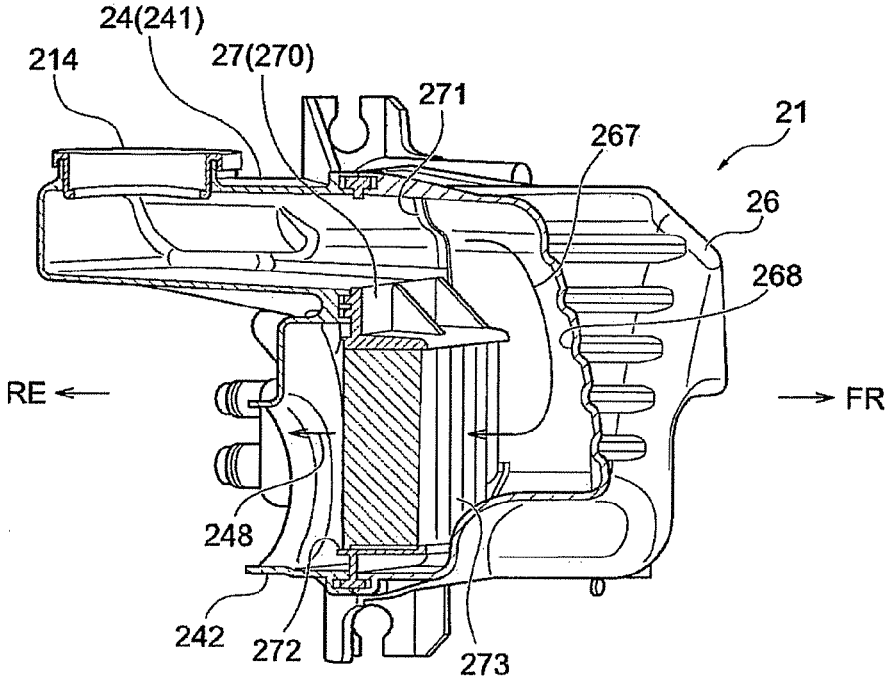

Subsequently, the intake air path in the intake silencer box 21 of the illustrative embodiment is described in detail with reference to FIGS. 9A and 9B. FIGS. 9A and 9B are detailed views of the intake silencer box 21 provided for the intake apparatus 2 of the illustrative embodiment. FIG. 9A is a plan view of the intake silencer box 21. FIG. 9B is a sectional view taken along a line X-X shown in FIG. 9A.

As shown in FIGS. 9A and 9B, the air filter element 27 is interposed between the main body part 24 and the cover part 26. A space in the duct part 241 of the main body part 24 is coupled to an internal space of the cover part 26 through the opening 271 of the frame 270 of the air filter element 27. Also, a space in the cover part 26 is coupled to a space in the guide part 242 of the main body part 24 through the opening 272 of the frame 270. Here, the space in the guide part 242 is a first air passage 248 configured to guide the air for combustion having passed through the air filter element 27 in the axial direction of the cylinder. Also, the space in the cover part 26 and the space in the duct part 241 are a second air passage 267 configured to guide the air for combustion introduced from the intake duct 20 to the air filter element 27. In this case, a downstream end of the second air passage 267 is coupled to the first air passage 248, and an upstream end (the coupling part 243) of the second air passage 267 opens to the outside (the intake duct 20).

The air for combustion introduced into the intake silencer box 21 from the intake duct 20 passes through a part of the second air passage 267 formed in the duct part 241 and the cover part 26 and flows to the front of the outboard motor 1 along the axial direction of the cylinder. While the air for combustion is guided by the inner wall part of the cover part 26, the flowing direction of the air is reversed. Then, the air flows into the air filter element 27. The air for combustion having passed through the air filter element 27 flows into the throttle body 22 and the intake manifold 23 through the first air passage 248. Like this, a part of the inner wall part of the cover part 26 forms a reversal part 268 configured to reverse the air flowing direction of the downstream side of the second air passage 267 relative to the air flowing direction of the upstream side of the second air passage 267 by about 180°.

A part of the water contained in the air for combustion is separated from the air for combustion while it passes through the second air passage 267. As described above, while the air for combustion is guided by the inner wall part (the reversal part 268) of the cover part 26, the flowing direction of the air is reversed. At this time, the air for combustion collides with the inner wall of the cover part 26, so that the water contained in the air for combustion is further separated and is collected at the lower part of the cover part 26. The water, which is not completely separated in the cover part 26, is captured by the filter part 273 of the air filter element 27. Since the filter part 273 is formed of the water-shedding fabric, the water captured by the filter part 273 moves down along the filter part 273 by the gravity and flows to the lower part of the cover part 26. Therefore, the air filter element 27 is not clogged by the water such as ocean water. As a result, it is possible to prolong the lifetime of the air filter element 27. The water collected at the lower part of the cover part 26 can be drained to the outside from the drain hole 266 through the drain cap 212 having one way valve in the draining direction.

In this way, since the water contained in the air for combustion is captured by the intake silencer box 21, it is possible to prevent the entry of the water into the engine 12. Also, the air filter element 27 is arranged at the downstream side of the cover part 26, so that it is possible to separate the water in advance before the air for combustion passes through the air filter element 27. For this reason, the air for combustion containing the water does not directly pass through the air filter element 27. As a result, it is possible to prolong the lifetime of the air filter element 27, so that it is possible to reduce a replacement frequency of the air filter element 27.

As described above, according to the intake apparatus 2 of the illustrative embodiment, the intake manifold 23, the throttle body 22 and the intake silencer box 21 are intensively arranged at the right side of the engine block 121, and the intake introduction port 151 provided at the upper part of the engine cover 14 and the intake silencer box 21 are coupled by the intake duct 20. For this reason, it is possible to circulate the exterior air by using the right space of the engine block 121 and supply the exterior air to the throttle body 22. Thereby, it is possible to prevent a size of the apparatus main body (particularly, a size in the vertical direction) from being enlarged. Also, since the intake silencer box 21 is provided and the resonator part 203 is provided in communication with the duct unit 202 of the intake duct 20, it is possible to reduce the intake noise on the flow path to the throttle body 22. Furthermore, since the first water separation part is provided between the intake introduction port 151 and the intake duct 20 and the second water separation part is provided at a part of the resonator part 203, it is possible to separate the water contained in the exterior air on the flow path to the throttle body 22. As a result, it is possible to suppress the intake noise and to effectively prevent the entry of the water into the engine 12 without enlarging the apparatus main body.

Also, according to the intake apparatus 2 of the illustrative embodiment, since the third water separation part is provided in a part of the intake silencer box 21 configured to reverse the flowing direction of the intake air in the intake duct 20 and the flowing direction of the intake air in the throttle body 22 and intake manifold 23, it is possible to further separate the water contained in the air for combustion (the exterior air). Thereby, it is possible to more effectively prevent the entry of the water into the engine 12.

The intake duct 20 and the intake manifold 23 configured to overlap with the cylinder in the engine 12 in the right and left reaction of the outboard motor 1 are arranged parallel to each other and side by side in the vertical direction. For this reason, it is possible to arrange the intake duct 20 apart from the cylinder of high temperatures. Thereby, it is possible to prevent the air for combustion (the exterior air) circulating through the intake duct 20 from being warmed up due to the heat generated from the cylinder. As a result, it is possible to improve the intake packing efficiency of the engine 12 without enlarging the apparatus main body.

Also, according to the intake apparatus 2 of the illustrative embodiment, the resonator part 203 configured to reduce the intake noise is provided in communication with the duct part 202 configuring the intake passage of the intake duct 20, and the resonator part 203 is arranged below the intake duct 20 and side by side in the vertical direction between the intake duct 20 and the intake manifold 23. Thereby, it is possible to use the resonator part 203 as a shield member of the heat generated from the cylinder. As a result, it is possible to further improve the intake packing efficiency of the engine 12 by the air (the exterior air) circulating through the intake duct 20.

The present invention is not limited to the illustrative embodiment and can be variously changed and implemented. In the above illustrative embodiment, the sizes, the shapes and the like shown in the accompanying drawings are not limited thereto and can be appropriately changed within the range in which the effects of the present invention are exhibited. In addition, the illustrative embodiment can be appropriately changed and implemented without departing from the scope of the present invention.

For example, in the above illustrative embodiment, the intake manifold 23, the throttle body 22 and the intake silencer box 21 are intensively arranged at the right side of the engine block 121. However, the intake manifold 23, the throttle body 22 and the intake silencer box 21 may be arranged at the left side of the engine block 121. In this case, the exhaust-system components of the engine 12, the oil filter 41 and the various electric components are preferably arranged at the right side of the engine block 121.

Also, in the above illustrative embodiment, the guide member 31 configuring a part of the upper cover 15 is provided with the upstanding wall part 322 functioning as the first water separation part. However, the arrangement of the first water separation part is not limited to the part of the guide member 31 and can be appropriately changed. The first water separation part can be arranged at an arbitrary position inasmuch as it is positioned between the intake introduction port 151 and the opening 201 of the intake duct 20.

Also, according to the intake apparatus 2 of the above illustrative embodiment, the intake duct 20 is configured as the combined body in which the duct part 202 having the exterior air introduction function and the resonator part 203 having the resonator function are integrally combined. However, the configuration of the intake apparatus 2 is not limited thereto and can be appropriately changed. For example, an intake duct having the exterior air introduction function and a resonator chamber having the resonator function may be provided as separate components. In the meantime, even when the resonator chamber is provided as the separate component from the intake duct, the resonator chamber is preferably arranged at the same position as the resonator part 203.

As described above, the present invention has the effect of suppressing the intake noise and effectively preventing the entry of the water into the engine without enlarging the apparatus main body, and is particularly useful for an intake apparatus for supplying an air for combustion to an engine mounted to an outboard motor.

In addition, the present invention has the effect of improving the intake packing efficiency by the exterior air without enlarging the apparatus main body, and is particularly useful for an intake apparatus for supplying an air for combustion to an engine mounted to an outboard motor.

What is claimed is:

1. An intake apparatus of an engine for an outboard motor in which an intake manifold, a throttle body and an intake silencer box which are coupled to an upstream end side of the intake manifold are arranged at one of right and left sides of an engine block which is configured such that an axial direction of a cylinder coincides with a front and rear direction of the outboard motor, wherein an intake duct configured to communicate with an intake introduction port provided at an upper part of an engine cover is coupled to an upstream end of the intake silencer box, and wherein a first water separation part is arranged between the intake introduction port and the intake duct, a second water separation part is provided below a duct part of the intake duct, and the second water separation part is formed by providing a drain hole at a bottom part of a resonator chamber part configured to communicate with the duct part to reduce an intake noise.

2. The intake apparatus according to claim 1, wherein a flowing direction of an intake air flowing in the intake duct and a flowing direction of the intake air flowing in the throttle body and the intake manifold are reversed in the front and rear direction of the outboard motor in the intake silencer box which couples the intake duct and the throttle body, and a bottom part of the intake silencer box is provided with a drain hole to form a third water separation part.

3. The intake apparatus according to claim 2, wherein the intake introduction port is provided at a rear side of the outboard motor, and an intake passage is formed such that the intake air flowing in the intake duct flows from the rear side of the outboard motor towards a front side thereof.

4. An intake apparatus of an engine for an outboard motor in which an intake manifold, a throttle body and an intake silencer box which are coupled to an upstream end side of the intake manifold are arranged at one of right and left sides of an engine block which is configured such that an axial direction of a cylinder coincides with a front and rear direction of the outboard motor, wherein an intake duct configured to communicate with an intake introduction port provided at an upper part of an engine cover is coupled to an upstream end of the intake silencer box, wherein the intake duct includes a cylindrical duct part extending in the front and rear direction of the outboard motor and a coupling part coupling a downstream end of the duct part with the intake silencer box, wherein the intake duct and the intake manifold are arranged parallel to each other and side by side in a vertical direction.

5. The intake apparatus according to claim 4, wherein a resonator chamber configured to communicate with an intake passage of the intake duct to reduce an intake noise is provided, and the resonator chamber is arranged below the intake duct and side by side in the vertical direction between the intake duct and the intake manifold.

6. The intake apparatus of an engine for an outboard motor according to claim 5, wherein a combined body in which the intake duct and the resonator chamber are integrally combined is formed by coupling a first member and a second member each of which has a part of a space formed in the intake duct and the resonator chamber, and at least one of the first member and the second member is formed with a communication passage configured to communicate the intake duct with the resonator chamber.

* * * * *